US011065907B2

(12) United States Patent
Kageyama et al.

(10) Patent No.: US 11,065,907 B2
(45) Date of Patent: Jul. 20, 2021

(54) HAND TOOLS, COSMETIC DEVICES AND WRITING INSTRUMENTS

(71) Applicants: Kotobuki & Co., Ltd., Kawagoe (JP); G4 DE MEXICO SA DE CV, Zapopan (MX)

(72) Inventors: Hidehei Kageyama, Kawagoe (JP); Takeshi Wakayama, Kawagoe (JP)

(73) Assignees: KOTOBUKI & CO., LTD., Kawagoe (JP); G4 DE MEXICO SA DE CV, Zapopan Jalisco (MX)

( * ) Notice: Subject to any disclaimer, the term of this patent is extended or adjusted under 35 U.S.C. 154(b) by 0 days.

(21) Appl. No.: 16/657,371

(22) Filed: Oct. 18, 2019

(65) Prior Publication Data

US 2021/0114400 A1 Apr. 22, 2021

(51) Int. Cl.

| | |
|---|---|
| ***B43K 24/06*** | (2006.01) |
| ***A45D 40/20*** | (2006.01) |
| ***B43K 7/00*** | (2006.01) |

(52) U.S. Cl.

CPC ..... *B43K 24/06* (2013.01); *A45D 40/20* (2013.01); *B43K 7/005* (2013.01)

(58) Field of Classification Search

CPC ..... B43K 7/005; B43K 7/12; B43K 21/00; B43K 21/006; B43K 21/02; B43K 21/085; B43K 24/06; B43K 24/14; B43K 24/143; B43K 24/146; B43K 24/00–186; B43K 7/00–12; A45D 40/20; A45D 40/205; A45D 40/00; A45D 2040/0025–0062; A45D 40/02–2040/208

See application file for complete search history.

(56) References Cited

U.S. PATENT DOCUMENTS

| | | | | | |
|---|---|---|---|---|---|
| 2,395,710 | A * | 2/1946 | Anderson | A45D 40/06 | 401/69 |
| 2,565,601 | A * | 8/1951 | Fischer | B43K 24/06 | 401/116 |
| 2,657,794 | A * | 11/1953 | Edward | A45D 40/12 | 401/61 |
| 3,027,873 | A * | 4/1962 | Lanoie | B43K 24/06 | 401/116 |
| 3,106,190 | A * | 10/1963 | Reinhard | B43K 7/035 | 401/141 |
| 3,346,103 | A * | 10/1967 | Swenson | A45D 40/06 | 401/74 |
| 3,436,160 | A * | 4/1969 | Lanoie | B43K 24/06 | 401/116 |
| 4,529,328 | A * | 7/1985 | Wacha | B43K 7/005 | 401/116 |

(Continued)

FOREIGN PATENT DOCUMENTS

JP S63-191697 A 8/1988

*Primary Examiner* — Patrick M. Buechner

(74) *Attorney, Agent, or Firm* — McGinn IP Law Group, PLLC

(57) ABSTRACT

A hand tool includes an outer barrel, an inner barrel housed in the outer barrel, and a rear barrel assembled to the outer barrel and the inner barrel. One of the outer barrel and the inner barrel includes a cam follower protruding in a radial direction of the hand tool, the other of the outer barrel and the inner barrel includes a cam groove engaging with the cam follower, and the cam follower is supported to be movable in a radial direction.

16 Claims, 4 Drawing Sheets

(56) References Cited

U.S. PATENT DOCUMENTS

| | | | | |
|---|---|---|---|---|
| 5,547,301 | A * | 8/1996 | Kageyama | B43K 24/06 401/109 |
| 6,217,241 | B1 * | 4/2001 | Kobayashi | B43K 24/14 401/195 |
| 6,454,480 | B2 * | 9/2002 | Rigoni | B43K 24/06 401/107 |
| 9,539,848 | B2 * | 1/2017 | Bez | B43K 24/026 |
| 2006/0291947 | A1 * | 12/2006 | Kageyama | B43L 19/0081 401/52 |

* cited by examiner

HAND TOOLS, COSMETIC DEVICES AND WRITING INSTRUMENTS

FIELD

The embodiments discussed herein relate to hand tools, for example, cosmetic devices or writing instruments.

BACKGROUND

A conventional writing instrument, such as Japanese Patent Application Publication No. 1988-191697, hereinafter, referred to as Patent Document 1, includes an outer barrel 1, a refill 2 housed in the outer barrel 1, a slider 4 fitted into a rear end of the refill 2 that includes a protrusion 3 on the outer surface thereof, and a rotation cap 5 fitted into the slider 4 that is rotatably fitted into a rear end of the outer barrel 1 so as not to be freely movable in an axial direction, in which rotation cap 5 includes a spiral slit 6 corresponding to an operational stroke and a tip end projecting slit 7 communicating with the spiral slit 6 to project a tip end of the refill 2 from a tip of the outer barrel 1, the outer barrel includes an axial passage 8 corresponding to the operational stroke and a tip projecting passage 9 communicating with the axial passage 8 to project the tip of the refill 2 from the tip of the outer barrel 1, at least one of the tip projecting slit 7 and the tip projecting passage 9 is formed in a spiral shape, and the protrusion 3 of the slider 4 is slidably fitted into the spiral slit 6, one of the axial passage 8 and the tip end projecting slit 7, and the tip projection passage 9, has been known (see, e.g., line 9 in lower left column to line 6 in lower right column in page 2 of Patent Document 1.) With the writing instrument disclosed by Patent Document 1, it is possible to provide, in the same configuration, a compatible writing instrument that can be used as both of a rotary ball pen and a rotary mechanical pencil by a rotational operation simply by replacing a refill for a ball pen and a refill for a mechanical pencil.

However, it has been desired to provide a hand tool, a cosmetic device, and a writing instrument having higher productivity than conventional ones.

SUMMARY

In one exemplary aspect of the present invention, a hand tool includes an outer barrel, an inner barrel housed in the outer barrel, and a rear barrel assembled to the outer barrel and the inner barrel, wherein one of the outer barrel and the inner barrel includes a cam follower protruding in a radial direction, the other of the outer barrel and the inner barrel includes a cam groove engaging the cam follower, and the cam follower is supported (e.g., resiliently supported) to be movable in a radial direction.

In another exemplary aspect of the present invention, the hand tool further includes a cosmetic material to be configured as a cosmetic device.

In other exemplary aspects of the invention, the hand tool further includes a writing body to be configured as a writing instrument.

In the above-mentioned exemplary embodiments, it is possible to provide a hand tool, a cosmetic device, and a writing instrument having higher productivity than conventional ones.

The present invention will become more fully understood from the detailed description given hereinbelow. The other applicable fields will become apparent with reference to the detailed description given hereinbelow. However, the detailed description and the specific exemplary embodiment are illustrated of desired embodiments of the present invention and are described only for the purpose of explanation. Various changes and modifications will be apparent to those ordinarily skilled in the art on the basis of the detailed description. The applicant has no intention to give to the public any disclosed embodiments. Among the disclosed changes and modifications, those which may not literally fall within the scope of the present claims constitute, therefore, a part of the present invention in the sense of doctrine of equivalents.

BRIEF DESCRIPTION OF DRAWINGS

The exemplary aspects of the invention will be better understood from the following detailed description of the exemplary embodiments of the invention with reference to the drawings in which.

DESCRIPTION OF EXEMPLARY EMBODIMENTS

Figure 1:
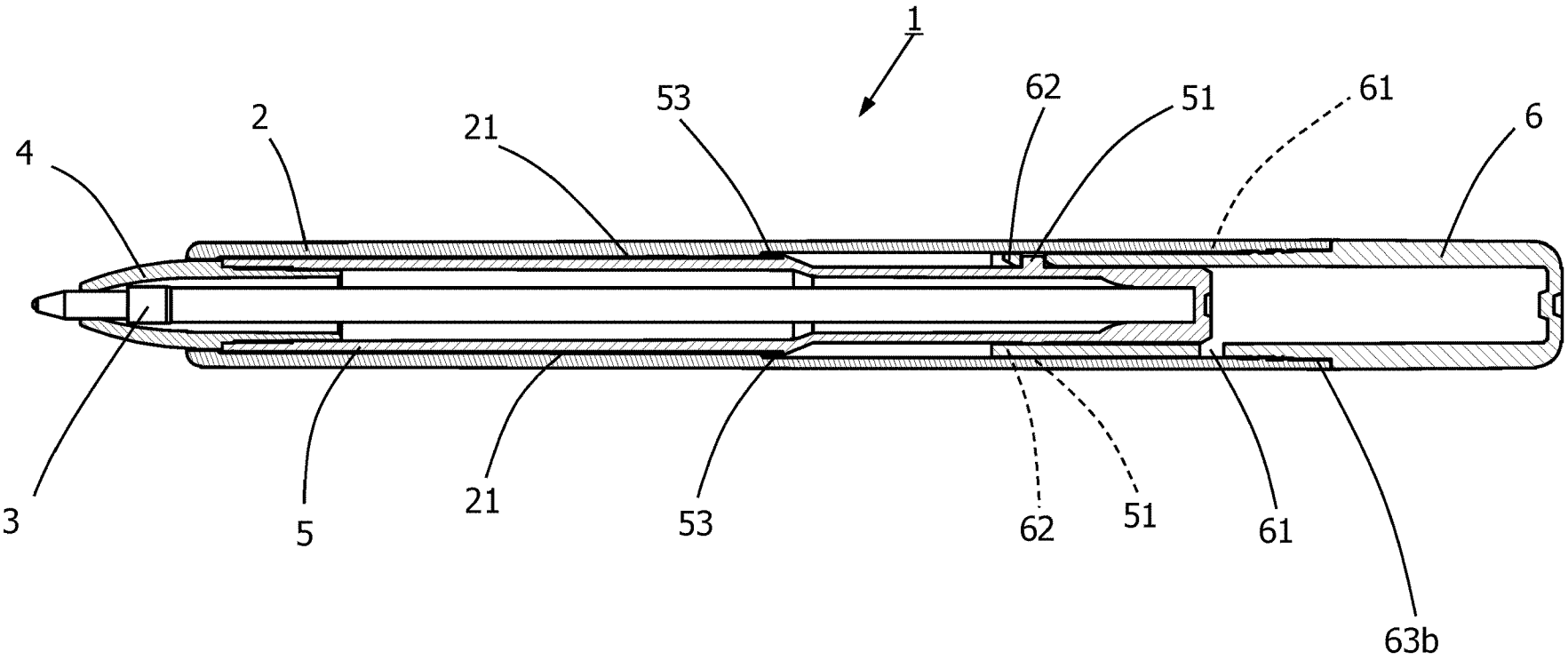
FIG. 1 is a cross-sectional view of a hand tool in a protruding condition according to an exemplary embodiment.
Figure 2:
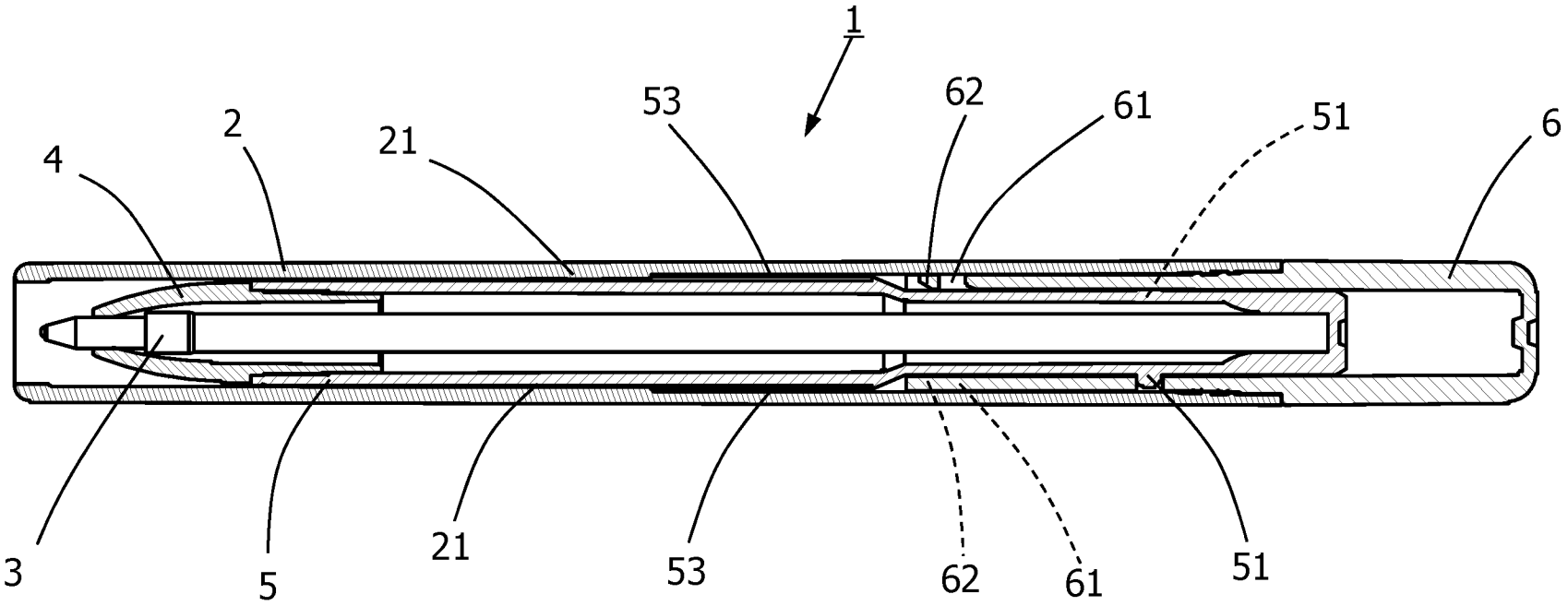
FIG. 2 is a cross-sectional view of the hand tool in a retracted condition according to the exemplary embodiment.

FIG. 1 is a cross-sectional view of a ball pen 1 (or cosmetic device) as a hand tool in a protruding condition according to an exemplary embodiment. FIG. 2 is a cross-sectional view of the ball pen 1 in a retracted condition according to the exemplary embodiment. The ball pen 1 includes an outer barrel 2, a ball pen refill 3, which is a writing body, a tip fitting 4, an inner barrel 5, and a rear barrel 6. The outer barrel 2 is formed in a substantially tubular shape and disposed on the outer side in the radial direction of the ball pen 1. The ball pen refill 3 includes an ink on the inside thereof and a user can write with a tip disposed at one end thereof. In the following explanation, along the center axis (referred to as "axis") in the longitudinal direction of the ball pen 1, a side where the tip of the ball pen refill 3 is disposed is referred as a front end of the ball pen 1 and the opposite side of the front end is referred as a rear end.

The inner barrel 5 is formed in a substantially tubular shape having the bottom at the rear end thereof. When an outer circumferential surface of a rear end of the ball pen refill 3 is fitted to an inner circumferential surface of a rear end of the inner barrel 5, the ball pen refill 3 is assembled to the inner barrel 5. The tip fitting 4 is formed in a tapered substantially tubular shape. When the tip fitting 4 is screwed to a front end of the inner barrel 5, the ball pen refill 3 is held on the inside of an assembly of the tip fitting 4 and the inner barrel 5. On an inner circumferential surface of the outer barrel 2, a pair of slide ribs 21 protruding toward the inner side in the radial direction and extending in the axial direction are formed so as to be apart from each other by 180 degrees in the circumferential direction. On an outer circumferential surface of the inner barrel 5, a pair of guide grooves 53, recessed toward the inner side in the radial direction and extending in the axial direction, are formed so as to be apart from each other by 180 degrees in the circumferential direction. The pair of slide ribs 21 of the outer barrel 2 slidably engage with the pair of guide grooves 53 of the inner barrel 5. Consequently, the inner barrel 5 can slide and move in the axial direction on the inside of the outer barrel 2.

Figure 4:
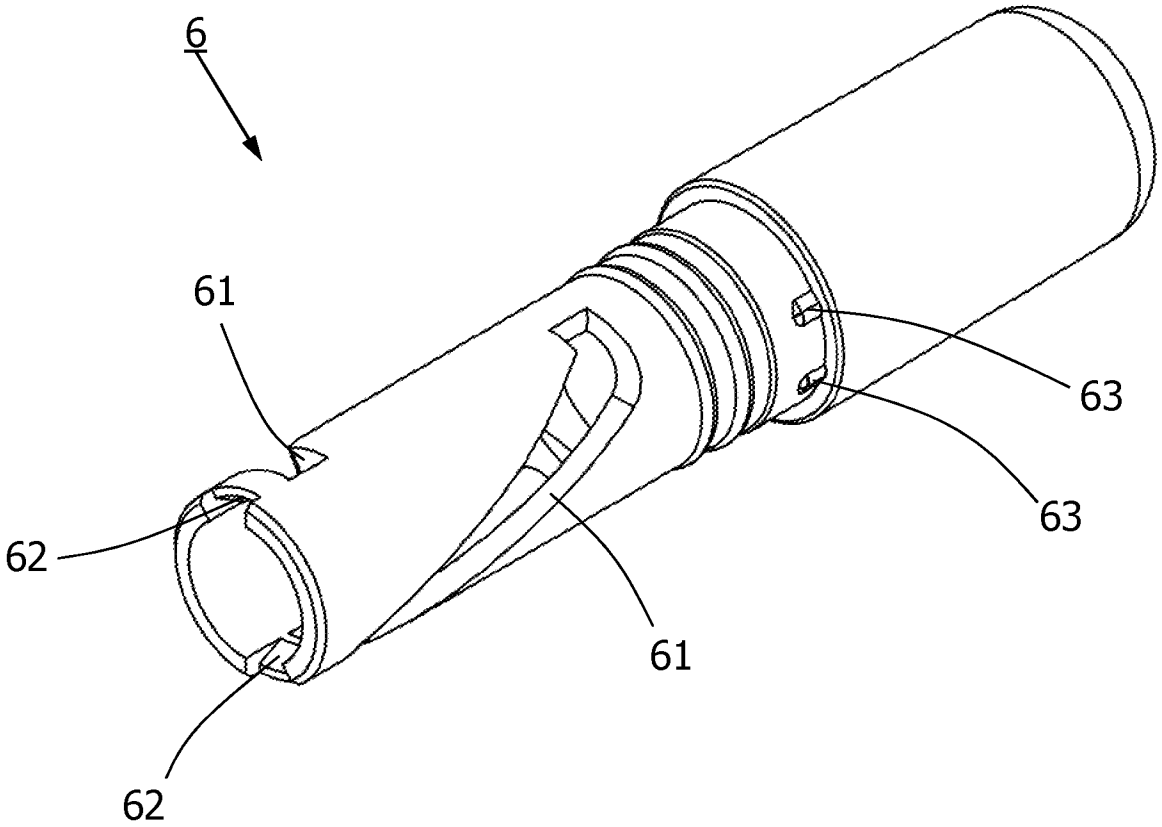
FIG. 4 illustrates a rear barrel of the hand tool according to the exemplary embodiment.

The rear barrel 6 is assembled to rear portions of the outer barrel 2 and the inner barrel 5. As shown in FIGS. 1 and 2, on an inner circumferential surface of a rear end portion of the outer barrel 2, two annular ribs protruding toward the inner side in the radial direction and extending in the circumferential direction, are formed. As shown in FIG. 4, on an outer circumferential surface of a central portion of the rear barrel 6, two annular ribs protruding to the outer side in the radial direction and extending in the circumferential direction, are formed. When the rear barrel 6 is pressed and assembled into the inside of the outer barrel 2, the two annular ribs of the outer barrel 2 and the two annular ribs of the rear barrel 6 mutually engage to be relatively rotatable in the circumferential direction and immovable in the axial direction.

On an outer circumferential surface of a rear portion of the inner barrel 5, a pair of cam followers 51, formed in a substantially columnar shape and protruding to the outer side in the radial direction, are formed so as to be apart from each other by 180 degrees in the circumferential direction. In a front portion of the rear barrel 6, a pair of cam grooves 61 (see FIG. 4), engaging with the pair of cam followers 51 of the inner barrel 5, are formed so as to be apart from each other by 180 degrees in the circumferential direction. When the rear barrel 6 rotates in one direction in the circumferential direction relatively to the outer barrel 2, the cam followers 51 of the inner barrel 5 are pressed by the cam grooves 61 of the rear barrel 6 and advance while rotating in the one direction in the circumferential direction. When the inner barrel 5 moves forward, the ball pen refill 3 comes into a projected state in which the ball pen refill 3 projects from a front end of the outer barrel 2 and becomes writable with the ball pen refill 3.

When the rear barrel 6 rotates in another direction in the circumferential direction relatively to the outer barrel 2, the cam followers 51 of the inner barrel 5 are pressed by the cam grooves 61 of the rear barrel 6 and retract while rotating in the other direction in the circumferential direction. When the inner barrel 5 retracts, the ball pen refill 3 comes into a housed state in which the ball pen refill 3 is housed inside the outer barrel 2 and can be protected.

Figure 3:
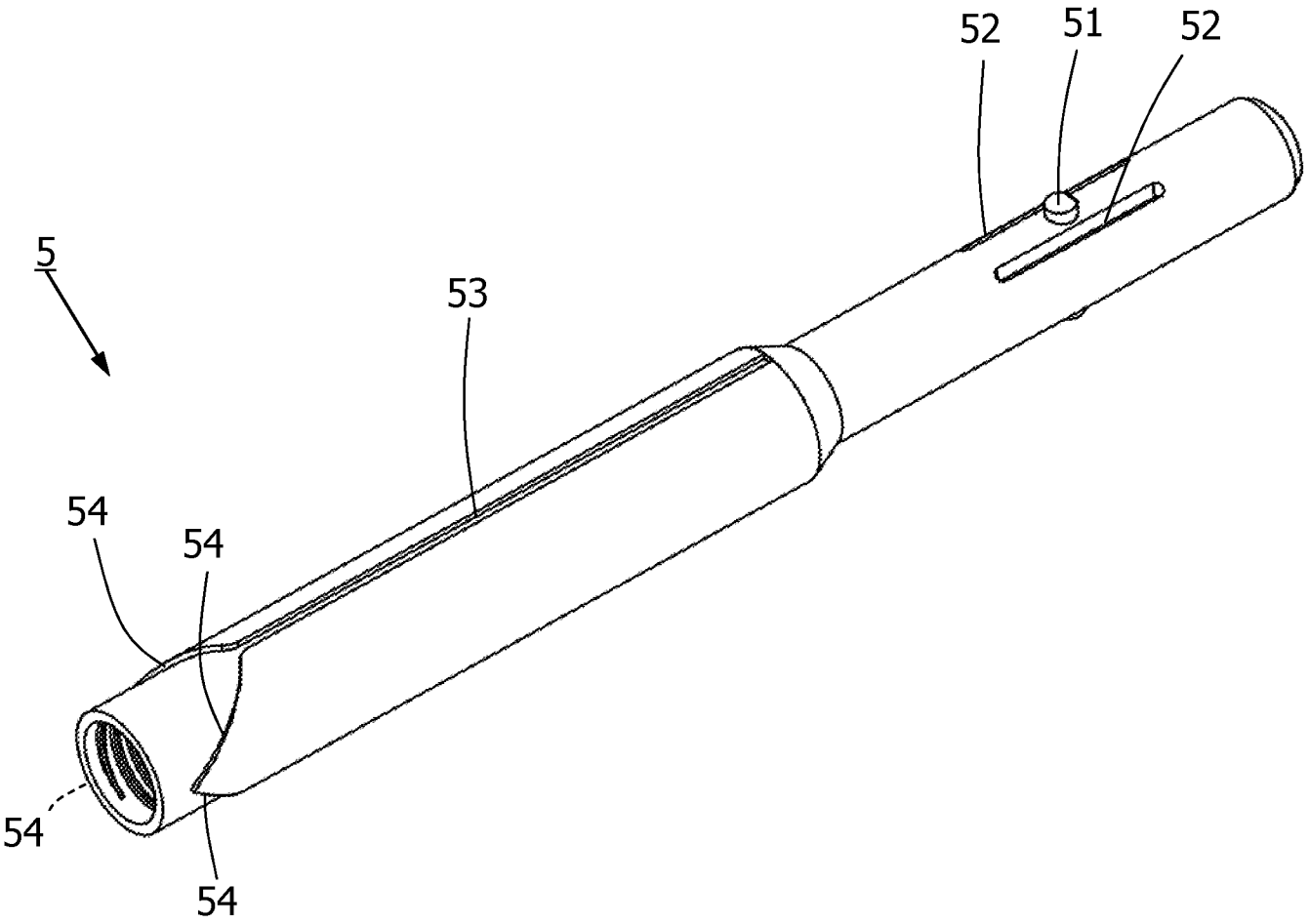
FIG. 3 illustrates an inner barrel of the hand tool according to the exemplary embodiment.

FIG. 3 illustrates the inner barrel 5 of the ball pen 1 according to the exemplary embodiment. In near (e.g., adjacent) positions in the circumferential direction of the cam followers 51 of the inner barrel 5, a pair of slits 52 opened in the radial direction and extending in the axial direction are formed across the cam followers 51. Since the pair of slits 52 are formed across the cam followers 51, the cam followers 51 of the inner barrel 5 are supported (e.g., resiliently supported) to be movable in the radial direction. With such a configuration, since the cam followers 51 of the inner barrel 5 can move toward the inner side in the radial direction, the ball pen 1 can be manufactured with higher productivity than conventional ones, such as by inserting and assembling the rear portion of the inner barrel 5 into a front opening of the rear barrel 6. For example, the inner barrel 5 may be inserted into the rear barrel 6 using an automatic assembly machine. The inner barrel 5 that holds the cam followers 51 between the pair of slits 52 and resiliently supports the cam followers 51 can be formed with high productivity by resin molding. In another exemplary embodiment, an inner barrel may further include, in a near-front position or a near-rear position in the axial direction of the cam follower 51, an additional slit extending in the circumferential direction to couple the pair of slits 52. In this case, the cam followers 51 can be configured to be more greatly movable toward the inner side in the radial direction. Therefore, the rear portion of the inner barrel 5 can be more easily inserted and assembled into the front opening of the rear barrel 6.

FIG. 4 illustrates the rear barrel 6 of the ball pen 1 according to the exemplary embodiment. Further, on an inner circumferential surface of the front end of the rear barrel 6, inclined surfaces 62, inclined with respect to the axial direction such that the cam followers 51 of the inner barrel 5 can move toward the inner side of the radial direction, are formed. With such a configuration, when the inner barrel 5 is inserted into the rear barrel 6, the cam followers 51 of the inner barrel 5 can move toward the inner side of the radial direction due to the inclined surfaces 62 of the rear barrel 6. Therefore, it is possible to manufacture the ball pen 1 with further higher productivity. Further, in this exemplary embodiment, notches (unreferenced in FIG. 4) are formed at the front end of the rear barrel 6 and each of the notches includes the inclined surface 62. The inclined surfaces 62 are formed at the rear end of the notches. With such a configuration, the cam followers 51 of the inner barrel 5 and the inclined surfaces 62 of the rear barrel 6 can be aligned by engaging the cam followers 51 of the inner barrel 5 in the notches of the rear barrel 6. Therefore, for example, by inserting the inner barrel 5 into the rear barrel 6 while rotating the inner barrel 5 in the circumferential direction, the cam followers 51 of the inner barrel 5 are first engaged in the notches of the rear barrel 6 in the circumferential direction so that the cam followers 51 of the inner barrel 5 and the inclined surfaces 62 of the rear barrel 6 align. Subsequently, the cam followers 51 of the inner barrel 5 are engaged with the inclined surfaces 62 of the rear barrel 6 in the axial direction, to assemble the inner barrel 5 to the rear barrel 6. In this case, it is possible to manufacture the ball pen 1 with further higher productivity using an automatic assembly machine.

Further, the rear barrel 6 may be configured to be deformable in the radial direction by a reaction force of the movement of the cam followers 51 of the inner barrel 5. In this exemplary embodiment, the rear barrel 6 is widened and deformed to the outer side of the radial direction to increase in the inner diameter of the rear barrel 6 by the reaction force of the cam followers 51 moving to the inner side in the radial direction. In this case, it is possible to more easily insert the inner barrel 5 into the rear barrel 6 and assemble the inner barrel 5 to the rear barrel 6.

In the ball pen 1 in this embodiment, two ribs 63 protruding toward the outer side in the radial direction and extending in the axial direction are formed on an outer circumferential surface of the rear barrel 6. On the inner circumferential surface of the outer barrel 2, one rib (not illustrated in the figures but labeled in FIG. 1 as 63*b*) having substantially the same shape as the ribs 63 protruding toward the inner side in the radial direction and extending in the axial direction is formed. When the rear barrel 6 is rotated in the circumferential direction relatively to the outer barrel 2, the ribs 63 of the rear barrel 6 and the rib of the outer barrel 2 engage with each other to indicate, with a click, a rotating position of the rear barrel 6 relative to the outer barrel 2 in the circumferential direction. With such a configuration, it is possible to inform, with a click, a projecting position and a housed position of the ball pen 1 to the user. Therefore, the user can more easily use the ball pen 1. The indication by the click in this embodiment is indication to the tactile sense of the user. However, in another embodiment, the indication by the click may be indication to the auditory sense of the user.

As shown in FIG. 3, the inner barrel 5 further includes inclined inducing-guide surfaces 54 obtained by widening, in the circumferential direction, one end in the axial direction of the guide grooves 53. In this exemplary embodiment, a pair of inclined inducing-guide surfaces 54 are formed to be wider in the circumferential direction toward the front. With such a configuration, when the inner barrel 5 is inserted into the outer barrel 2, positions in the circumferential direction of the guide grooves 53 of the inner barrel 5 with respect to the slide ribs 21 of the outer barrel 2 can be aligned by the inclined inducing-guide surfaces 54. Therefore, the guide grooves 53 of the inner barrel 5 can be more easily assembled to the slide ribs 21 of the outer barrel 2 than conventional ones. Accordingly, it is possible to manufacture the ball pen 1 with higher productivity than conventional ones. In another exemplary embodiment, an inclined inducing-guide surface may be formed on one of opposed sidewall surfaces in the guide grooves 53. Even in this case, substantially the same effects, as the effects obtained when the pair of inclined inducing-guide surfaces 54 are formed at one ends of the guide grooves 53 as explained above, may be obtained.

The pair of inclined inducing-guide surfaces 54 are desirably widened in the circumferential direction until a central angle around the axial line reaches a central angle of 90 degrees or more (e.g., each of the inclined inducing-guide surfaces 54 covers a central angle of 45 degrees or more.) In this case, even when the positions in the circumferential direction of the guide grooves 53 of the inner barrel 5 with respect to the slide ribs 21 of the outer barrel 2 are greatly offset, the guide grooves 53 and the slide ribs 21 can be aligned by the inclined inducing-guide surfaces 54. The pair of inclined inducing-guide surfaces 54 are more desirably widened in the circumferential direction until the central angle around the axial line reaches a central angle of 160 degrees or more (e.g., each of the inclined inducing-guide surfaces 54 covers a central angle of 80 degrees or more.) In this case, even when the positions in the circumferential direction of the guide grooves 53 of the inner barrel 5 with respect to the slide ribs 21 of the outer barrel 2 are more greatly offset, the guide grooves 53 and the slide ribs 21 can be aligned by the inclined inducing-guide surfaces 54. The pair of inclined inducing-guide surfaces 54 in this exemplary embodiment are widened in the circumferential direction until the central angle around the axial line reaches a central angle of 180 degrees. Each of the inclined inducing-guide surfaces 54 covers a central angle of 90 degrees.

In this exemplary embodiment, the pair of guide grooves 53 are formed to be apart from each other by 180 degrees in the circumferential direction in the inner barrel 5. Four inclined inducing-guide surfaces 54 formed at the tips of the respective guide grooves 53 are widened to cover the entire circumference of 360 degrees of the inner barrel 5. Therefore, irrespective of the positions in the circumferential direction of the guide grooves 53 of the inner barrel 5 with respect to the slide ribs 21 of the outer barrel 2, the guide grooves 53 of the inner barrel 5 can be aligned and engaged with and assembled to the slide ribs 21 of the outer barrel 2. Therefore, it is possible to manufacture the ball pen 1 with higher productivity. Further, if the inner barrel 5 is allowed to free-fall in the outer barrel 2 to assemble the guide grooves 53 of the inner barrel 5 to the slide ribs 21 of the outer barrel 2, then it is possible to manufacture the ball pen 1 with further higher productivity. In this case, for example, the ball pen 1 may be manufactured with higher productivity using, for example, an automatic assembly machine.

In the explanation in the exemplary embodiment, the cam followers 51 are formed in the inner barrel 5 and the cam grooves 61 are formed in the rear barrel 6. However, in another exemplary embodiment, cam grooves may be formed in an inner barrel and cam followers may be formed in a rear barrel.

In the explanation in the exemplary embodiment, the slide ribs 21 are formed in the outer barrel 2 and the guide grooves 53 are formed in the inner barrel 5. However, in another exemplary embodiment, guide grooves may be formed in an outer barrel and slide ribs may be formed in an inner barrel.

In the explanation in the exemplary embodiment, the two ribs 63 are formed on the outer circumferential surface of the rear barrel 6 and the rib engaging with the ribs 63 is formed on the inner circumferential surface of the outer barrel 2. However, in another exemplary embodiment, two ribs may be formed on the inner circumferential surface of an outer barrel and a rib engaging with the ribs of the outer barrel may be formed on the outer circumferential surface of the inner barrel.

In the explanation in the embodiment, the ball pen 1, which is a writing instrument, is configured as a hand tool. However, in another embodiment, another writing instrument such as a mechanical pencil or a marker may be configured as the hand tool. Alternatively, in still another embodiment, an article of stationery such as an eraser may be configured as the hand tool. In still another embodiment, a cosmetic device having a cosmetic material may be configured as the hand tool (see FIG. 1). In this case, an application body or the like for applying the cosmetic material can be housed in an outer barrel and protected. In still another embodiment, similarly, any hand tool such as a medical product or a building article may be configured.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Exemplary embodiments of this invention are described herein, including the best mode known to the inventors for carrying out the invention. Variations of those exemplary embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The exemplary invention is not limited to the exemplary embodiments detailed above. The specific configuration of each portion can be modified within the range not departing from the purpose of the exemplary invention.

The descriptions of the various exemplary embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

Further, Applicant's intent is to encompass the equivalents of all claim elements, and no amendment to any claim of the present application should be construed as a disclaimer of any interest in or right to an equivalent of any element or feature of the amended claim.

What is claimed is:

1. A hand tool, including:

an outer barrel;

an inner barrel housed in the outer barrel; and a rear barrel assembled to the outer barrel and the inner barrel, wherein the inner barrel includes a cam follower protruding in a radial direction of the hand tool, the rear barrel includes a cam groove engaging with the cam follower, and the cam follower is supported to be movable in the radial direction, the outer barrel includes a slide rib extending in an axial direction of the hand tool and protruding in the radial direction, the inner barrel includes a guide groove engaging with the slide rib, and an axial end of the guide groove includes an inclined inducing-guide surface widened in a circumferential direction of the hand tool.

2. The hand tool according to claim 1, wherein the rear barrel includes a first rib extending in an axial direction of the hand tool and protruding in a radial direction, and the outer barrel includes a second rib extending in the axial direction and protruding in the radial direction, and wherein, when the outer barrel and the rear barrel are relatively rotated to each other in the circumferential direction, the first and second ribs engage with each other to indicate a relative position of a rotation of the rear barrel to the outer barrel in a circumferential direction of the hand tool by a click.

3. The hand tool according to claim 1, further including a cosmetic material to be configured as a cosmetic device.

4. The hand tool according to claim 1, further including a writing body to be configured as a writing instrument.

5. The hand tool according to claim 1, wherein the cam follower is resiliently supported to be movable in the radial direction.

6. The hand tool according to claim 1, wherein the rear barrel includes a first rib extending in an axial direction of the hand tool and protruding in the radial direction, and the outer barrel includes a second rib extending in the axial direction and protruding in the radial direction.

7. The hand tool according to claim 6, wherein the first rib and the second rib engage with each other to indicate a relative position of a rotation of the rear barrel to the outer barrel in a circumferential direction of the hand tool.

8. The hand tool according to claim 1, wherein the rear barrel includes an inclined surface that inclines to an axial direction of the hand tool to move the cam follower in the radial direction.

9. The hand tool according to claim 8, wherein the rear barrel further includes a notch configured to be engaged with the cam follower, and the notch includes the inclined surface.

10. The hand tool according to claim 8, wherein the rear barrel deforms in the radial direction by a reaction force of a movement of the cam follower.

11. The hand tool according to claim 1, wherein the inclined inducing-guide surface covers a central angle of 45 degrees or more in the circumferential direction.

12. The hand tool according to claim 11, wherein the inclined inducing-guide surface covers a central angle of 80 degrees or more in the circumferential direction.

13. The hand tool according to claim 12, wherein the inclined inducing-guide surface covers a central angle of 90 degrees in the circumferential direction.

14. A hand tool, including:

a first barrel;

a second barrel housed in the first barrel;

a third barrel connected to the first barrel and the second barrel;

a cam follower formed in the second, barrel, and protruding in a radial direction of the hand tool; and a cam groove formed in the third barrel and engaging with the cam follower, wherein the cam follower is configured to be movable in the radial direction, the first barrel includes a slide rib extending in an axial direction of the hand tool and, protruding in the radial direction, the second barrel includes a guide groove engaging with the slide rib, and an axial end of the guide groove includes an inclined inducing-guide surface widened in a circumferential direction of the hand tool.

15. The hand tool according to claim 14, wherein the first barrel comprises an outer barrel, the second barrel comprises an inner barrel, and the third barrel comprises a rear barrel.

16. The hand tool according to claim 15, wherein the inner barrel comprises the cam follower, and the rear barrel comprises the cam groove, and wherein the rear barrel includes a first rib extending in an axial direction of the hand tool and protruding in the radial direction, and the outer barrel includes a second rib extending in the axial direction and protruding in the radial direction, and wherein the first rib and the second rib engage with each other to indicate a relative position of a rotation of the rear barrel to the outer barrel in a circumferential direction of the hand tool.

* * * * *